US006636548B1

(12) United States Patent
Leu et al.

(10) Patent No.: US 6,636,548 B1
(45) Date of Patent: Oct. 21, 2003

(54) BOTTOM ELECTRODE STRUCTURE OF ELECTRIC ARC FURNACE

(75) Inventors: Lin-Her Leu, Miao-Li (TW); Wei-Ping Lee, Miao-Li Hsien (TW)

(73) Assignee: Tung Ho Steel Enterprise Corporation, Taipei (TW)

( * ) Notice: Subject to any disclaimer, the term of this patent is extended or adjusted under 35 U.S.C. 154(b) by 0 days.

(21) Appl. No.: 09/450,928

(22) Filed: Nov. 29, 1999

(51) Int. Cl.[7] ..... F27D 1/00
(52) U.S. Cl. ..... 373/72; 373/94; 373/52
(58) Field of Search ..... 373/71–72, 94, 373/95, 96, 52, 36–38, 41, 108

(56) References Cited

U.S. PATENT DOCUMENTS 5,191,592 A * 3/1993 Janiak et al. ..... 373/108
5,268,924 A * 12/1993 Sakakibara et al. ..... 373/72
5,835,523 A * 11/1998 Becker et al. ..... 373/72

* cited by examiner

*Primary Examiner*—Tu Ba Hoang

(74) *Attorney, Agent, or Firm*—Pro-Techtor International Services

(57) ABSTRACT

A bottom electrode of a direct current electric arc furnace includes an electrode body extending through a hole defined in a bottom of the furnace. A circumferential flange is formed around a lower portion of the electrode body to which a ring connection member is attached. The connection member forms a ring channel defined by inner and outer walls from which inner and outer flanges radially extend in opposite directions. The inner flange is fixed to the circumferential flange of the electrode body by bolts. The outer flange is fixed to the furnace bottom for attaching the bottom electrode to the furnace bottom. The channel is located between the circumferential flange of the electrode body and an inside diameter of the hole defined in the furnace bottom for increasing radial distance between the electrode body and the hole of the furnace bottom. Insulative members are arranged on and under the circumferential flange of the electrode body for electrically isolating the electrode from the furnace bottom.

19 Claims, 13 Drawing Sheets

BOTTOM ELECTRODE STRUCTURE OF ELECTRIC ARC FURNACE

FIELD OF THE INVENTION

The present invention generally relates to a direct current (DC) electrical arc furnace, and in particular to a bottom electrode of a DC electrical arc furnace.

BACKGROUND OF THE INVENTION

Electrical arc furnaces have been widely used in refining metals, especially steel. Generally speaking, an electrical arc furnace takes the advantage of opposite electrodes arranged on top and bottom of a vessel to generate electrical arcs for melting raw material of metal disposed in the vessel. An example of the electrical arc furnace is disclosed in U.S. Pat. No. 5,191,592 issued on Mar. 2, 1993 to Robert A. Janiak and Nicolas Meysson and assigned to Clecim. FIG. 1 of the attached drawings shows the general structure of an electrical arc furnace. The electric arc furnace comprises a vessel 10, a top electrode 12 arranged on the top of the vessel 10 and several bottom electrodes 14 fixed to and extending through a bottom lid 16 of the vessel 10. The electrodes 12, 14 are connected to a power source, such as an electric main, for generating electric arc therebetween to melt the raw materials of metal disposed in the vessel 10.

FIG. 9 shows conventional bottom electrodes 14 mounted to the bottom lid 16 of the vessel 10. The bottom lid 16 defines a plurality of through holes 20 in which the bottom electrodes 14 are received. Each bottom electrode 14 has mounting means 22 for being mounted to the bottom lid 16 by bolts 24. The bottom lid 16 is attached to a bottom opening 28 of the vessel 10 by means of fastening pins 26 whereby the bottom electrodes 14 are partially inserted into the vessel 10.

Referring to FIGS. 10–12, each bottom electrode 14 comprises an elongate electrode body 30. The mounting means 22 comprises a circumferential flange 32 extending from a lower portion of the electrode body 30. A ring connection member 34 is positioned on the circumferential flange 32 and fixed thereto by bolts 36. The ring connection member 34 has an inside diameter substantially greater than an outside diameter of the electrode body 30 thereby defining a ring space 38 therebetween. The ring connection member 34 defines a plurality of holes 40 for receiving the bolts 24 that secure the ring connection member 34 to the bottom lid 16. The ring connection member 34 has an outside diameter greater than an inside diameter of the corresponding hole 20 of the bottom lid 16 for completely closing the hole 20.

A first insulation ring 42 is interposed between the bottom lid 16 of the vessel 10 and the ring connection member 34 and a second insulation ring 44 is interposed between the ring connection member 34 and the circumferential flange 32 of the bottom electrode 14 for electrically isolating the bottom electrode 14 from the vessel 10. An insulation collar 46 is fixed to the inside diameter of the ring connection member 34.

On the bottom lid 16 of the vessel 10, refractory material 48 in powder form are disposed as shown in FIGS. 12 and 13 for protection of the vessel 10. During the refining process, heavy metal impurity, such as lead, is molten and penetrates through the refractory powders 48 and sinks toward the bottom lid 16 as shown by curved lines of FIG. 13. Drainage holes 49 are defined in the bottom lid 16 through which the impurity flows out of the vessel 10. Conventionally, the impurity that flows out of the vessel 10 through the drainage holes 49 is not properly guided and may get contact with the bottom electrodes 14. Since the molten metal inside the vessel 10 and the bottom electrodes 14 are in general not in the same electrical potential, the contact therebetween causes a short-circuiting resulting in damage to the furnace thereby reducing the service life thereof and increasing the overall costs. The electric arc furnace disclosed in Clecim patent has to be inspected after 1500 batches and the bottom electrodes 14 have to changed. This causes an increase of costs.

Thus, it is desired to provide a bottom electrode of electric arc furnace in order to overcome the problems discussed above.

SUMMARY OF THE INVENTION

Accordingly, an object of the present invention is to provide a bottom electrode of an electric arc furnace comprising impurity guide means for properly guiding the impurity flowing out of the furnace without contacting the bottom electrode thereby eliminating short-circuiting problem and reducing the costs.

Another object of the present invention is to provide a bottom electrode of an electric arc furnace, which has an extended service life thereby reducing the overall costs.

To achieve the above object, in accordance with the present invention, there is provided a bottom electrode of a direct current electric arc furnace comprising an electrode body extending through a hole defined in a bottom of the furnace. A circumferential flange is formed around a lower portion of the electrode body to which a ring connection member is attached. The connection member forms a ring channel defined by inner and outer walls from which inner and outer flanges radially extend in opposite directions. The inner flange is fixed to the circumferential flange of the electrode body by bolts. The outer flange is fixed to the furnace bottom for attaching the bottom electrode to the furnace bottom. The channel is located between the circumferential flange of the electrode body and an inside diameter of the hole defined in the furnace bottom for increasing radial distance between the electrode body and the hole of the furnace bottom. Insulative members are arranged on and under the circumferential flange of the electrode body for electrically isolating the electrode from the furnace bottom.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 1:
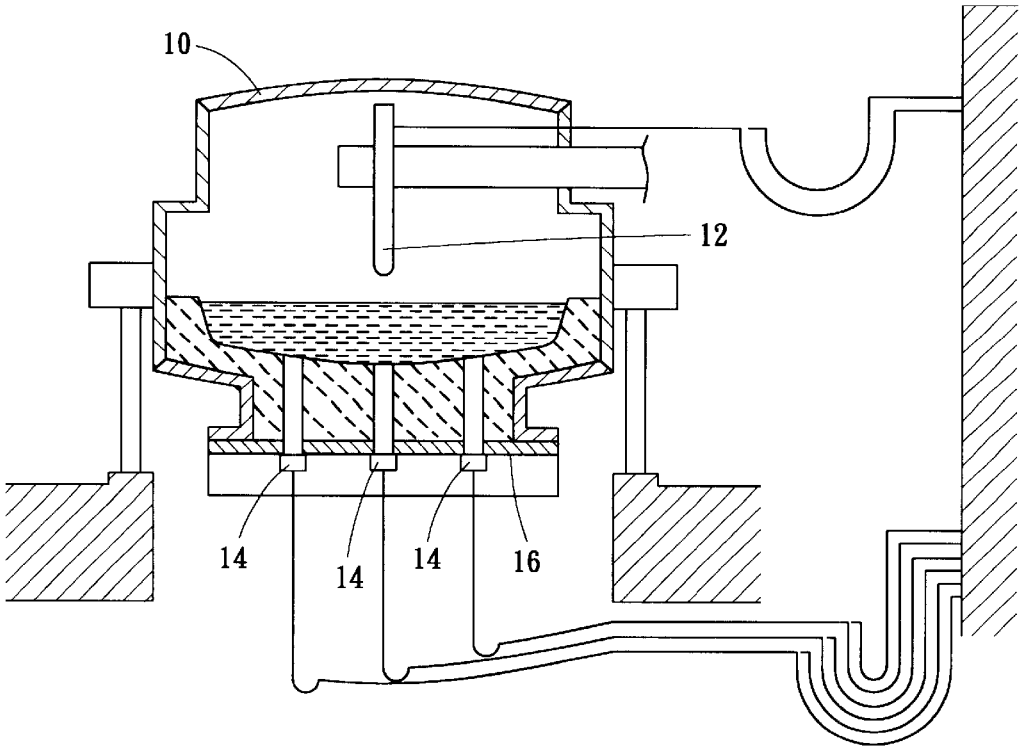
PRIOR ART Fig. 1
FIG. 1 is a schematic view of a direct current electric arc furnace.
Figure 2:
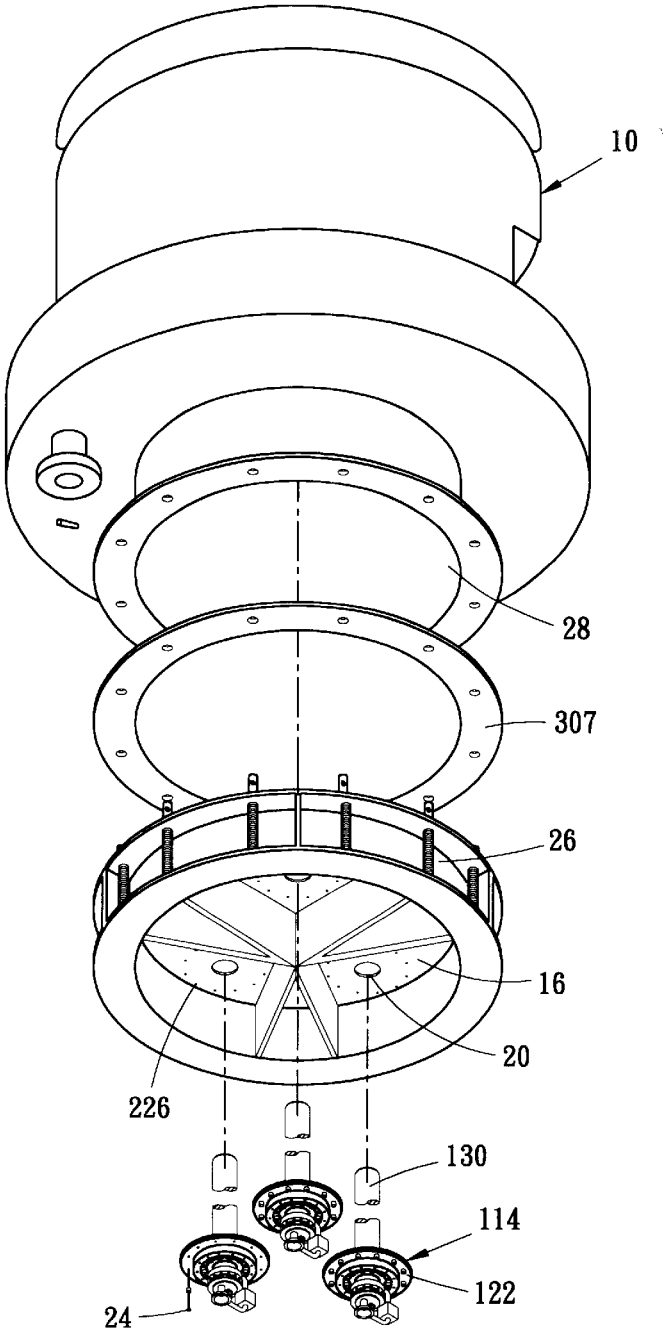
FIG. 2 is an exploded view of an electric arc furnace incorporating bottom electrodes constructed in accordance with the present invention.

With reference to the drawings and in particular to FIG. 2 wherein an electric arc furnace comprising a vessel 10 incorporating bottom electrodes constructed in accordance with the present invention, generally designated by reference numeral 114, is shown, the electric arc furnace 10 defines a bottom opening 10 to which a bottom lid 16 is attached by means of fasteners 26 to close the opening 28. The bottom lid 16 defines a plurality of through holes 20 for receiving the bottom electrodes 114 therein. Each bottom electrode 114 has mounting means 122 for being mounted to the bottom lid 16 by bolts 24 thereby allowing the bottom electrode 114 to extend into the vessel 10.

Figure 3:
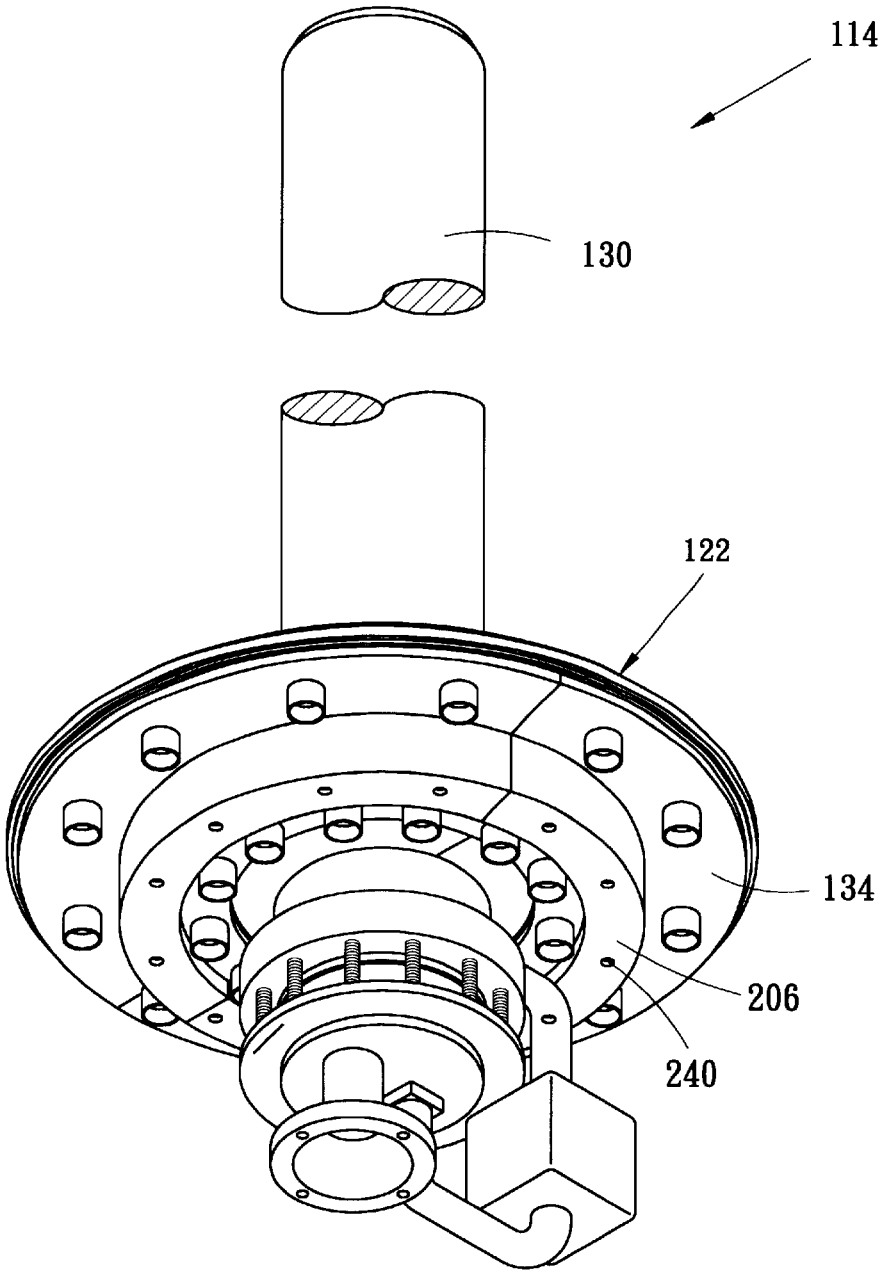
FIG. 3 is a perspective view of the bottom electrode of the electric arc furnace in accordance with the present invention.
Figure 4:
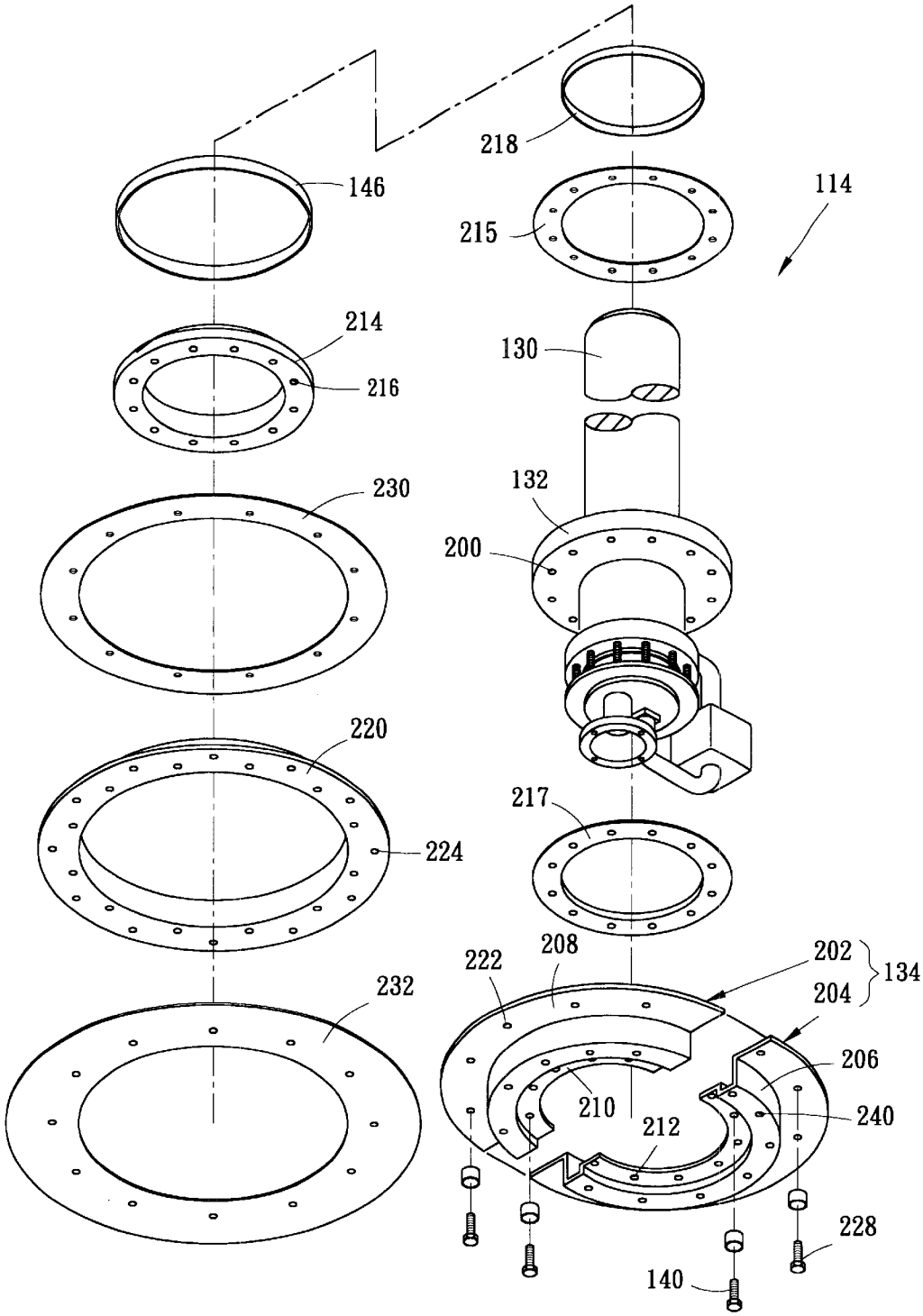
FIG. 4 is an exploded view of the bottom electrode of the electric arc furnace in accordance with the present invention.
Figure 5:
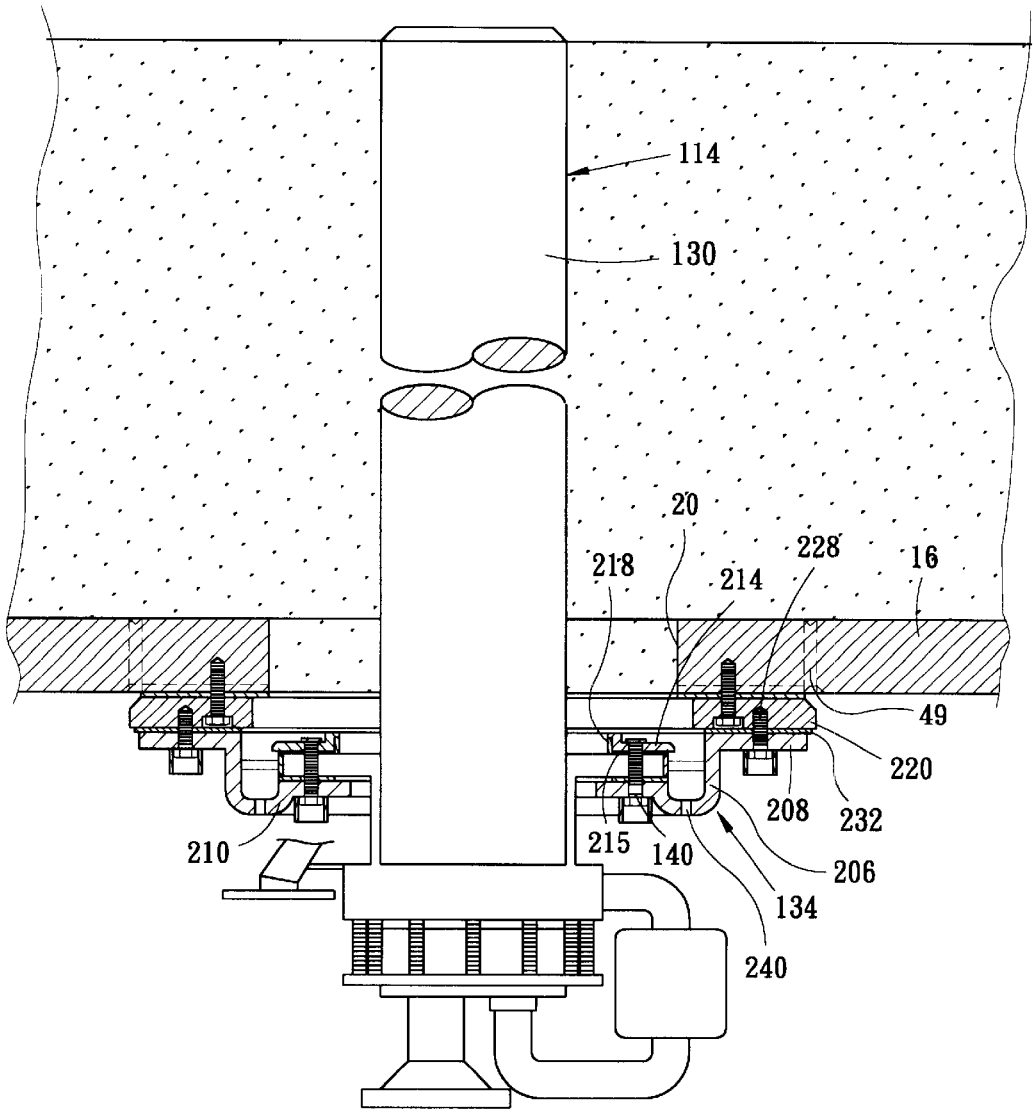
FIG. 5 is a cross-sectional view of a portion of the electric arc furnace showing the spatial relationship between the bottom electrode and a bottom lid of the electric arc furnace in accordance with the present invention.

As shown in FIGS. 3–5, each bottom electrode 114 comprises an elongate electrode body 130 and the mounting means 122 comprises a circumferential flange 132 formed on a lower portion of the electrode body 130 in which coolant circulation passage (not shown) is defined for maintaining the bottom electrode 114 at a proper temperature. This is known to those skilled in the art and thus no further details will be given herein.

Figure 6:
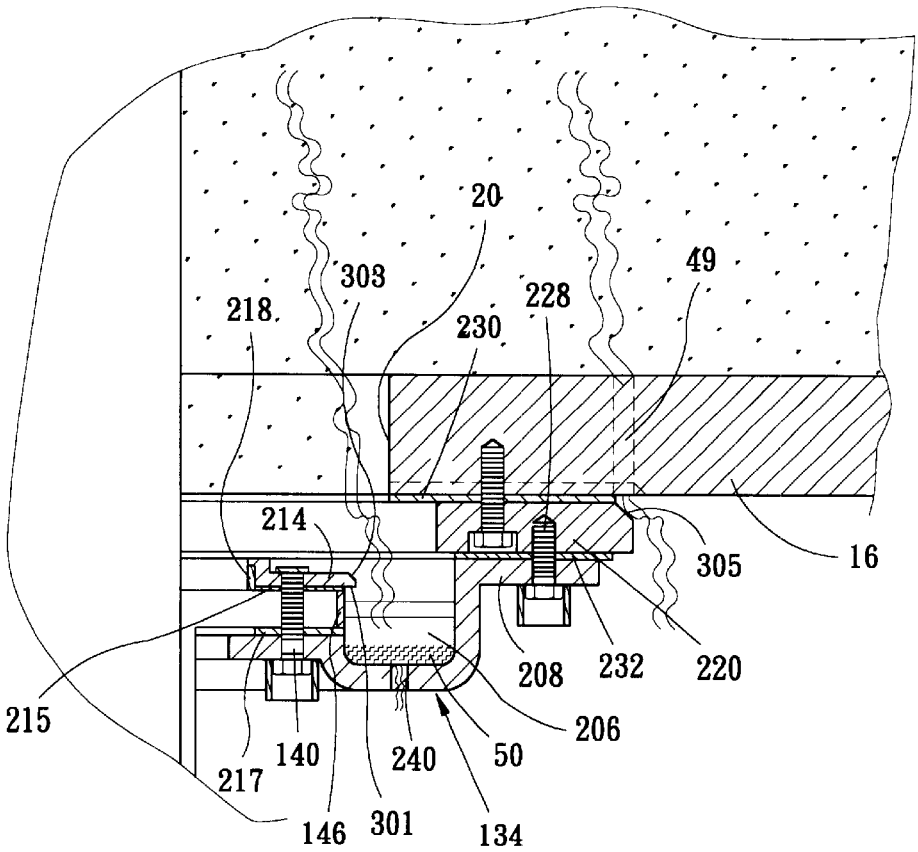
FIG. 6 is similar to FIG. 5 and showing impurity flowing toward the bottom electrode of the electric arc furnace.

A ring connection member 134 is arranged under the circumferential flange 132 of the electrode body 130. In the embodiment illustrated, the ring connection member 134 is constituted by two identical, semi-circular halves 202, 204. However, the ring connection member 134 may be a unitary member. The ring connection member 134 forms a coaxial ring projection (not labeled) coextensive therewith and a receptacle channel 206 is formed in the projection and defined by circumferential inner and outer walls (not labeled) which are substantially coaxial with the ring connection member 134. Outer flange 208 and inner flange 210 respectively extend from the outer and inner walls of the channel 206 in opposite directions. The inner flange 210 is secured to the circumferential flange 132 of the electrode body 130 by means of bolts 140 extending through holes 212 defined in the inner flange 210 and holes 200 defined in the circumferential flange 132 whereby the inner wall of the channel 206 is substantially flush with an outside circumferential surface (defining an outside diameter) of the circumferential ring 132 for smoothly guiding impurity, such as molten lead 50, into the channel 206 as illustrated in FIG. 6. Drainage holes 240 are defined in a bottom of the channel 206 for draining the molten lead 50 out of the electric arc furnace.

A fixing ring 214 having inside and outside circumferential surfaces (inside and outside diameters) and defining a plurality of through holes 216 therein is secured to the circumferential flange 132 of the electrode body 130 by the bolts 140 extending through the holes 216. Insulation rings 215, 217 are respectively interposed between the circumferential flange 132 and the fixing ring 214 and between the circumferential flange 132 and the inner flange 213 of the ring connection member 134. An insulation collar 146 is fit over the outside circumferential surface of the circumferential flange 132 and securely interposed between the insulation rings 215, 217 whereby the circumferential flange 132 is shielded by the insulation rings 215, 217 and the insulation collar 146. A second insulation collar 218 is fit over the inside circumferential surface of the fixing ring 214 thereby electrically isolating the fixing ring 214 and the circumferential flange 132 of the electrode body 130 from each other.

Also referring to FIG. 6, in accordance with the present invention, the fixing ring 214 is dimensioned so that an outer rim portion 301 proximate the outer circumferential surface thereof radially extends beyond the outer circumferential surface of the circumferential flange 132 a substantial distance (namely extending into the channel 206) whereby a step-like discontinuity is formed between the fixing ring 214 and the circumferential flange 132 for preventing the molten lead 50 from forming a continuous flow between the fixing ring 214 and the circumferential flange 132 and forcing the molten lead to form discrete liquid drops into the channel 206. By eliminating the continuous flow of molten lead between the fixing ring 214 and the circumferential flange 132, short-circuiting between the molten metal inside the vessel 10 and the bottom electrode 114 is avoided thereby effectively extending the service life of the bottom electrode 114. Preferably, an inclined face 303 is formed on the outside circumferential surface of the fixing ring 214 for guiding the molten lead into the channel 206.

A ring-shaped connection flange 220 having inside and outside circumferential surfaces is interposed between the outer flange 208 of the ring connection member 134 and the bottom lid 16. In the embodiment illustrated, the connection flange 220 and the ring connection member 134 together form the mounting means 122 of the bottom electrode assembly 114. Aligned holes 222, 224, 226 are respectively defined in the outer flange 208 of the ring connection member 134, the connection flange 220 and the bottom lid 16 of the vessel 10 for receiving bolts 228 which secure the ring connection member 134 and the connection flange 220 to the bottom lid 16 thereby fixing the bottom electrode 114 to the vessel 10 of the electric arc furnace. Preferably, the holes 224, 226 are inner-threaded for engaging with the bolts 228. Insulation rings 230, 232 are interposed between the connection flange 220 and the bottom lid 16 and between the connection flange 220 and the outer flange 208 of the ring connection member 134 for electrically isolating the bottom lid 16 and the ring connection member 134 from the connection flange 220.

In accordance with the present invention, inner and outer rim portions of the connection flange 220 proximate the inside and outside circumferential surfaces thereof radially extend in opposite directions beyond inner and outer surfaces of the outer flange 208 of the ring connection member 134 thereby forming step-like discontinuities therebetween of which the purposes and function are similar to the outer rim portion 301 of the fixing ring 214. No further detail will be given.

Preferably, an inclined face 305 is formed on the connection flange 220 proximate the outside circumferential surface thereof to be substantially aligned with the drainage holes 49 defined in the bottom lid 16 for guiding impurity to flow along the outside circumferential surface of the connection flange 220.

Furthermore, in accordance with the present invention, the holes 20 defined in the bottom lid 16 has a diameter smaller than the inside circumferential surface of the connection flange 220 whereby a step-like discontinuity is formed between the bottom lid 16 and the connection flange 220 for the same purposes of preventing formation continuous flow of molten lead and eliminating short-circuiting and extending the service life thereof.

Figure 7:
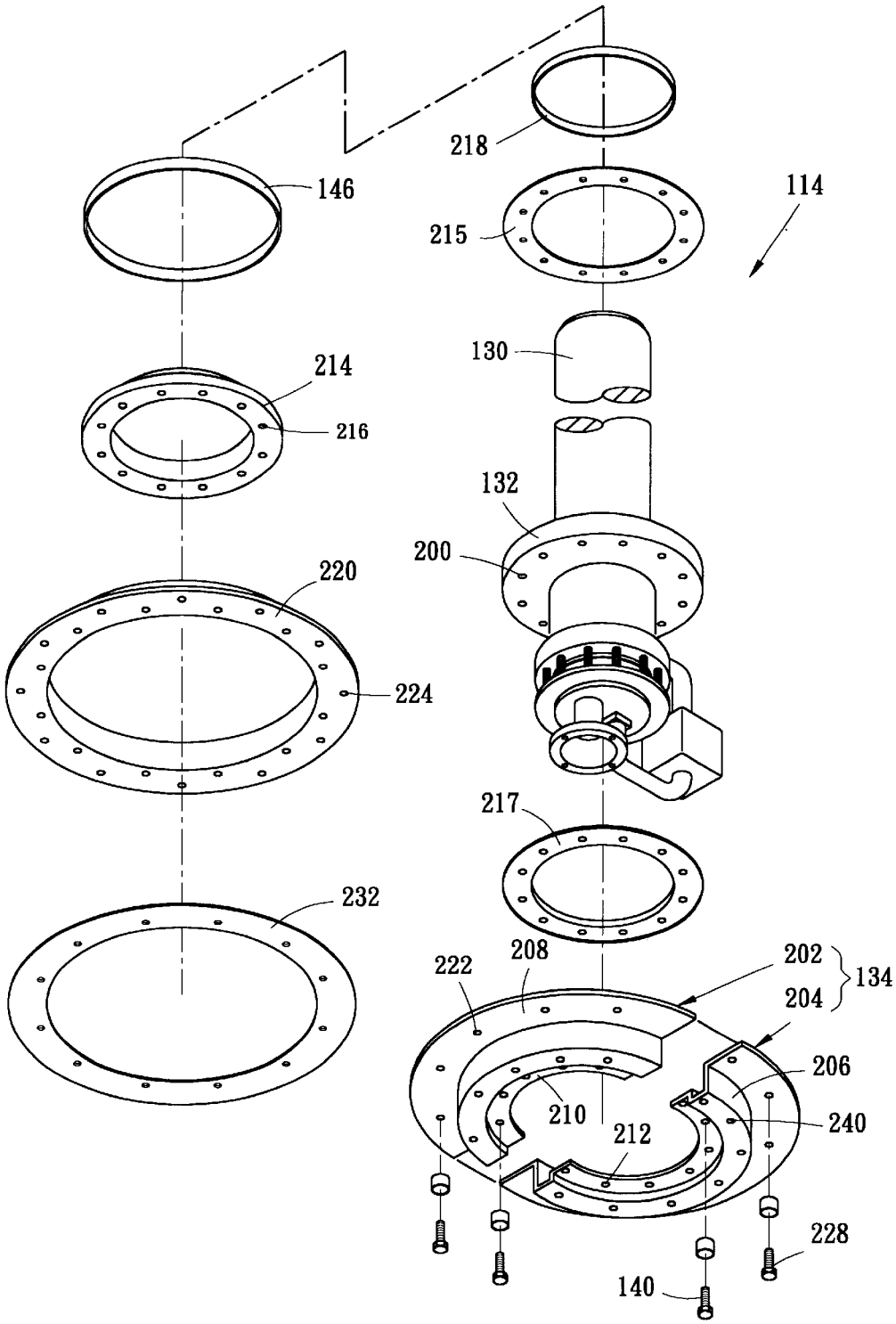
FIG. 7 is an exploded view of a bottom electrode constructed in accordance with a second embodiment of the present invention.
Figure 8:
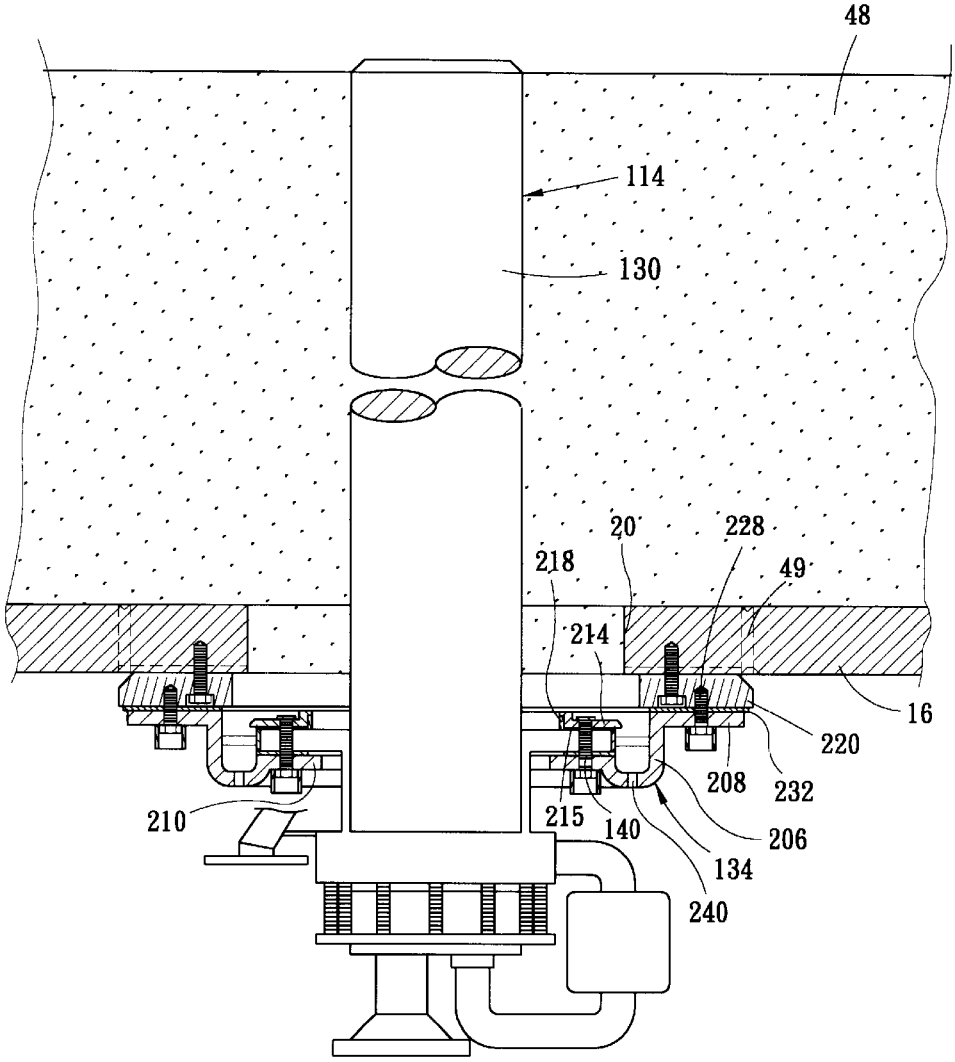
FIG. 8 is a cross-sectional view of a portion of the electric arc furnace showing the spatial relationship between the bottom electrode and a bottom lid of the electric arc furnace in accordance with the second embodiment of the present invention.
Figure 9:
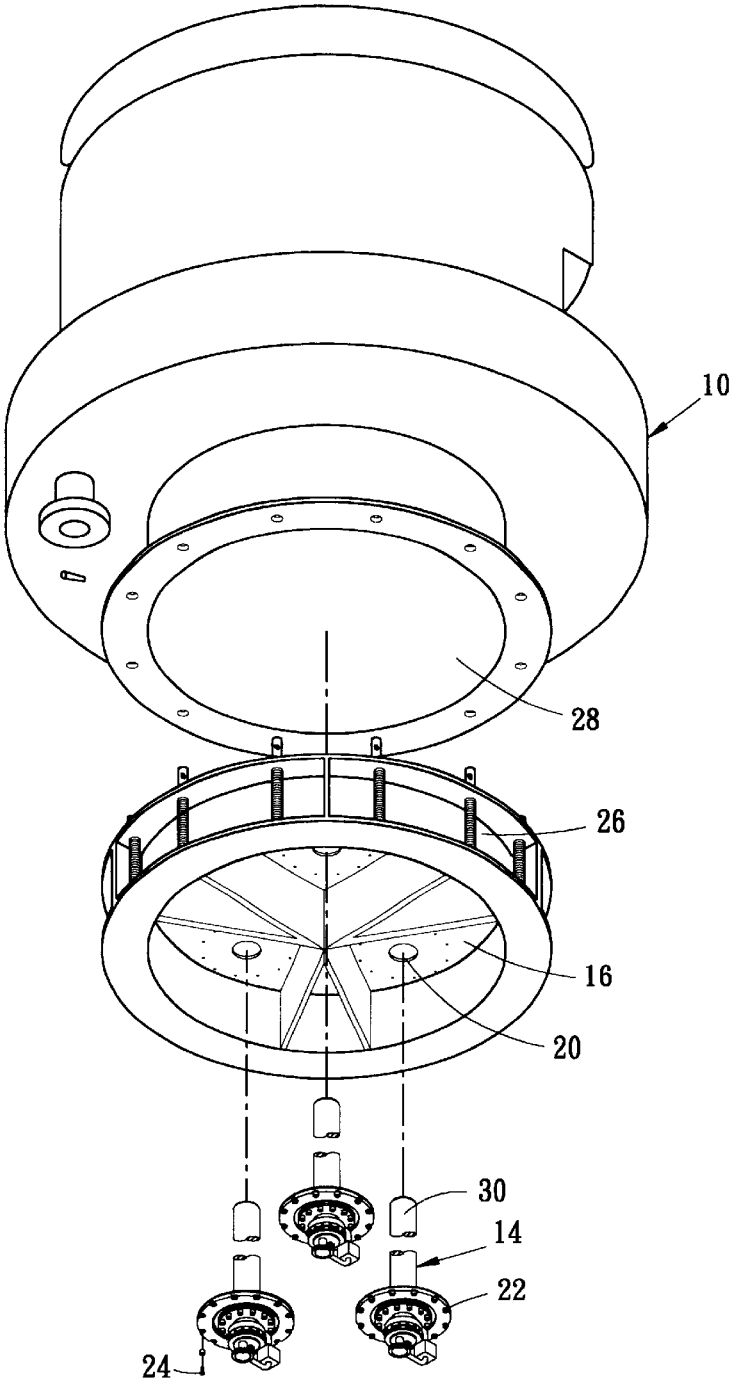
PRIOR ART Fig. 9
FIG. 9 is an exploded view of a conventional electric arc furnace.
Figure 10:
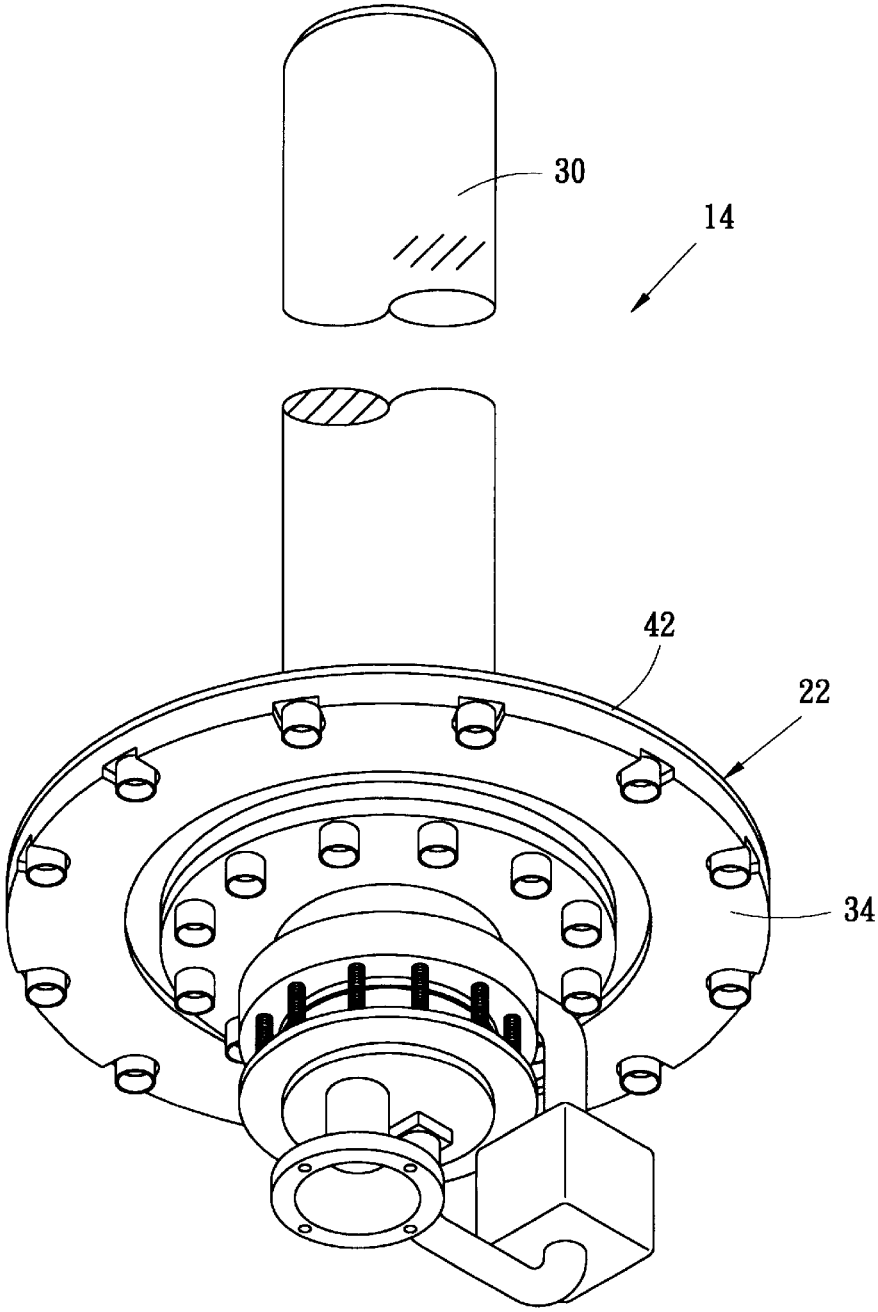
PRIOR ART Fig. 10
FIG. 10 is a perspective view of a conventional bottom electrode of the conventional electric arc furnace.
Figure 11:
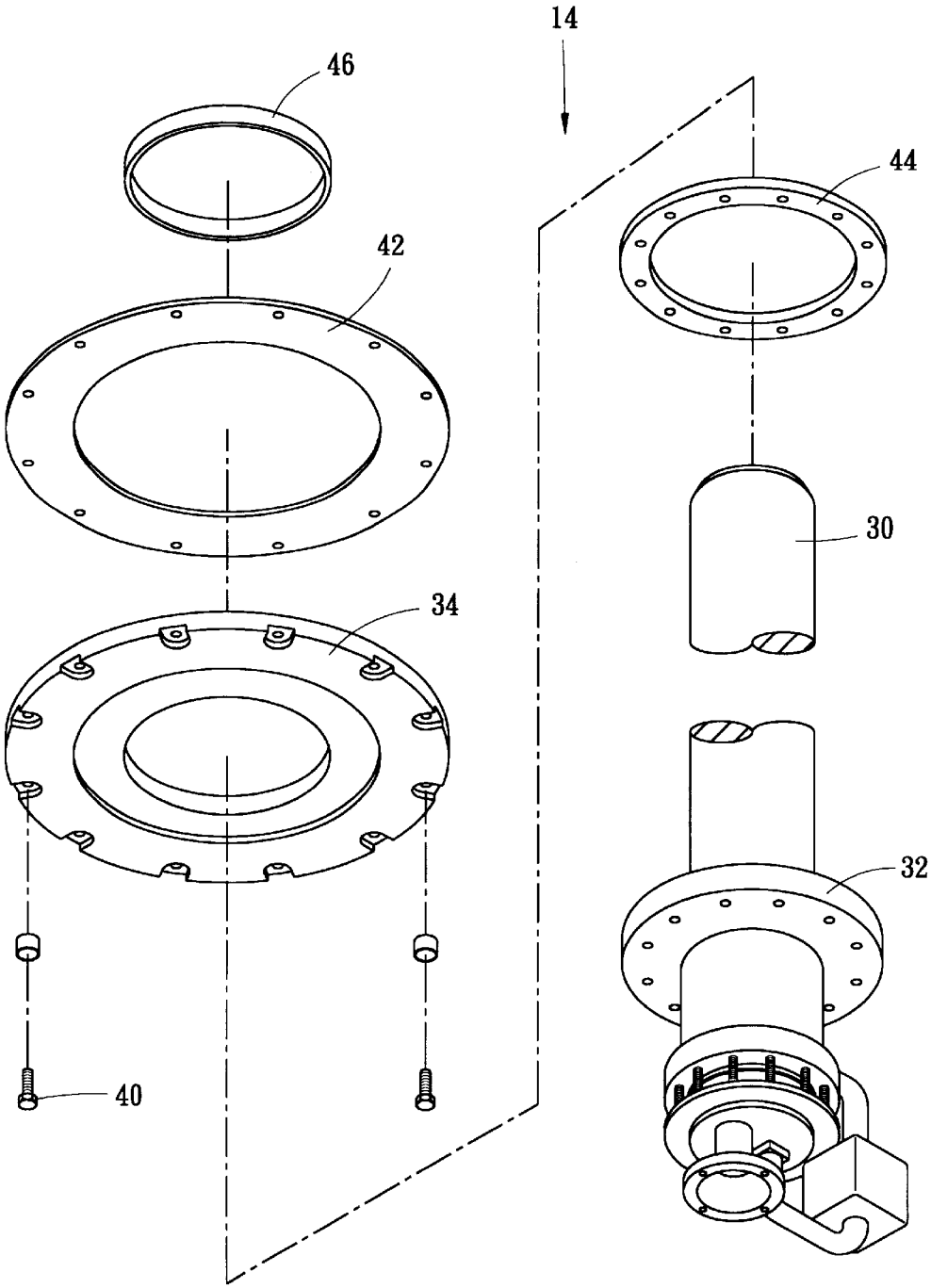
PRIOR ART Fig. 11
FIG. 11 is an exploded view of the conventional bottom electrode.
Figure 12:
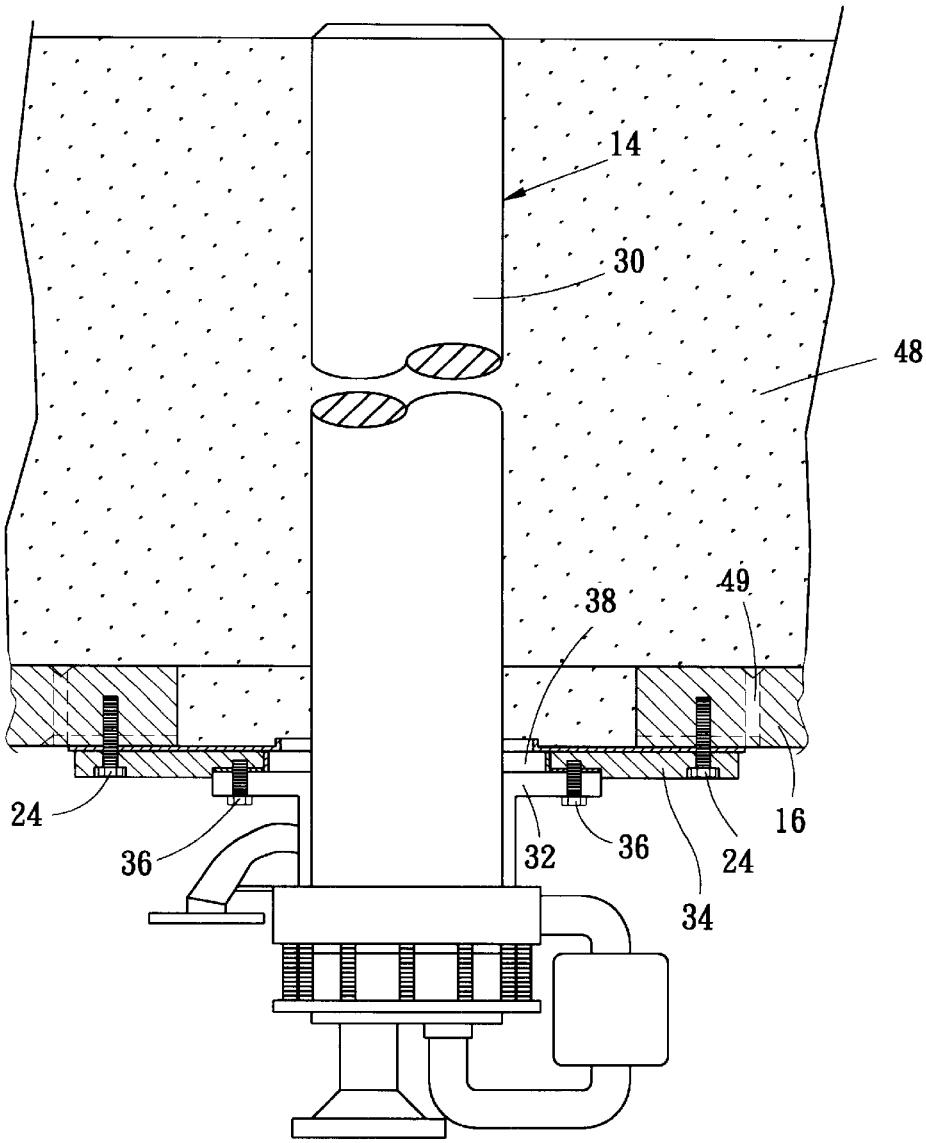
PRIOR ART Fig. 12
FIG. 12 is a cross-sectional view of a portion of the conventional electric arc furnace showing the spatial relationship between the bottom electrode and a bottom lid of the electric arc furnace.
Figure 13:
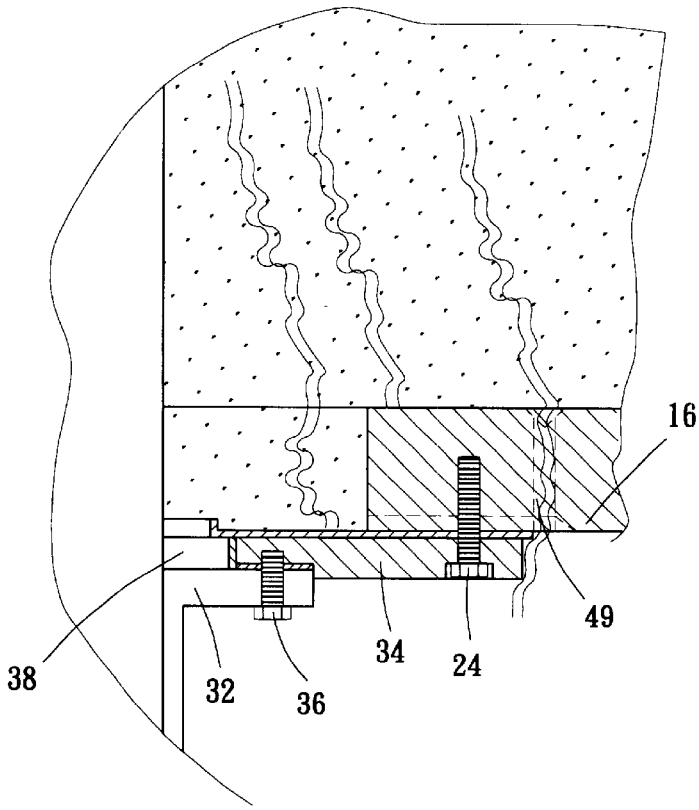
PRIOR ART Fig. 13
FIG. 13 is similar FIG. 12 and showing impurity flowing toward the conventional bottom electrode.

In practical operations, the insulation ring 230 between the connection flange 220 and the bottom lid 16 may be eliminated as illustrated in a second embodiment of the present invention shown in FIGS. 7 and 8.

A refractory material 48 in powder form is positioned on the bottom lid 16 of the electric arc furnace as shown in FIGS. 5 and 6 for protection of the bottom electrodes 114 and the vessel 10.

It should also be noted that in accordance with the present invention, by means of the formation of the receptacle channel 206 and enlarging the distance in the radial direction between the mounting means 122 (or the inside diameter of the hole 20) and the electrode body 130, the likelihood of short-circuiting is substantially reduced as compared with the conventional structure.

In addition, by interposing an insulation ring 307 (FIG. 2) between the bottom lid 16 and the bottom opening 28 of the vessel 10, the bottom lid 16 is electrically isolated from the vessel 10 for providing addition protection to the bottom electrodes 114.

By embodying the present invention in an electric arc furnace, the service life thereof is significantly extended to at least 5,000 batches. The cost saving due to the extension of the service life of the bottom electrodes 114 and the reduction of time and labor in maintaining and changing the bottom electrodes 114 is quite substantial.

The detailed structure described above and illustrated in the drawings is only the preferred embodiments of the present invention for description purposes, not to limit the scope of the present invention. Modifications, variations and substitutions of the elements and/or the structure of the present invention are considered within the scope of the present invention that is intended to be defined by the appended claims be defined by the appended claims.

What is claimed is:

1. A bottom electrode of a direct current electric arc furnace comprising:

an electrode body adapted to extend through a receiving hole defined in a bottom of the electric arc furnace, a circumferential flange being formed around the electrode body; and a connection member comprising a ring channel defined by inner and outer walls from which inner and outer flanges radially extend in opposite directions, the inner flange being fixed to the circumferential flange and the outer flange being fixed to the bottom of the electric arc furnace for attaching the bottom electrode to the bottom of the furnace, the channel being located between the circumferential flange and an inside diameter of the receiving hole of the bottom of the furnace in the radial direction.

2. The bottom electrode as claimed in claim 1, wherein a step-like discontinuity is formed between the outer wall of the channel and an inside diameter of the receiving hole of the bottom of the furnace.

3. The bottom electrode as claimed in claim 1 further comprising a ring-shaped connection flange interposed between the outer flange of the connection member and the bottom of the furnace.

4. The bottom electrode as claimed in claim 3, wherein the ring-shaped connection flange has an inner circumferential surface located between the outer wall of the channel and the inside diameter of the receiving hole of the bottom of the furnace whereby a step-like discontinuity is formed therebetween.

5. The bottom electrode as claimed in claim 3, wherein the ring-shaped connection flange has an outer circumferential surface having an outside diameter extending beyond an outside diameter of the outer flange of the connection member whereby a step-like discontinuity is formed therebetween.

6. The bottom electrode as claimed in claim 5, wherein an inclined face is formed on the outer circumferential surface substantially aligned with drainage holes defined in the bottom of the furnace for guiding impurity flowing out of the furnace.

7. The bottom electrode as claimed in claim 3, wherein an insulation ring is interposed between the ring-shaped connection flange and the outer flange of the connection member.

8. The bottom electrode as claimed in claim 3, wherein an insulation ring is interposed between the ring-shaped connection flange and the bottom of the furnace.

9. The bottom electrode as claimed in claim 1, wherein an insulation ring is interposed between the inner flange of the connection member and the circumferential flange of the electrode body.

10. The bottom electrode as claimed in claim 1 further comprising a fixing ring attached to an upper surface of the circumferential flange of the electrode body.

11. The bottom electrode as claimed in claim 10, wherein an insulation ring is interposed between the fixing ring and the circumferential flange of the electrode body.

12. The bottom electrode as claimed in claim 11, wherein the circumferential flange has an outside circumferential surface over which an insulation collar is fit.

13. The bottom electrode as claimed in claim 10, wherein the fixing ring has an inner circumferential surface over which an insulation collar is fit.

14. The bottom electrode as claimed in claim 10, wherein the fixing ring has an outer circumferential surface having an outside diameter extending beyond the inner wall of the channel thereby forming a step-like discontinuity therebetween.

15. The bottom electrode as claimed in claim 1, wherein the channel of the connection member receives molten impurity flowing from the furnace, at least one drainage hole being defined in a bottom of the channel for draining the impurity collected therein.

16. The bottom electrode as claimed in claim 10, wherein the fixing ring, the circumferential flange of the electrode body and the inner flange of the connection member define aligned holes through which bolts extend to secure the fixing ring, the electrode body and the connection member together.

17. The bottom electrode as claimed in claim 1, wherein holes are defined in the outer flange of the connection member for receiving bolts that secure the connection member to the bottom of the furnace.

18. The bottom electrode as claimed in claim 3, wherein the ring-like connection flange defines holes for receiving bolts that secure the connection flange to the bottom of the furnace.

19. The bottom electrode as claimed in claim 1, wherein an opening is defined in the bottom of the furnace to which a lid is attached to close the opening, an insulation ring being interposed between the lid and the bottom opening of the furnace.

* * * * *